US009303486B2

(12) United States Patent
Getzlaf et al.

(10) Patent No.: US 9,303,486 B2
(45) Date of Patent: Apr. 5, 2016

(54) TOOL ASSEMBLY INCLUDING AN EQUALIZATION VALVE

(71) Applicant: NCS Oilfield Services Canada Inc., Calgary (CA)

(72) Inventors: Donald Getzlaf, Calgary (CA); Marty Stromquist, Calgary (CA)

(73) Assignee: NCS Multistage, LLC, Calgary, Alberta (CA)

( * ) Notice: Subject to any disclaimer, the term of this patent is extended or adjusted under 35 U.S.C. 154(b) by 471 days.

(21) Appl. No.: 13/689,143

(22) Filed: Nov. 29, 2012

(65) Prior Publication Data

US 2013/0133891 A1 May 30, 2013

Related U.S. Application Data

(60) Provisional application No. 61/564,657, filed on Nov. 29, 2011.

(51) Int. Cl.

| | |
|---|---|
| ***E21B 34/12*** | (2006.01) |
| ***E21B 33/12*** | (2006.01) |
| ***E21B 43/26*** | (2006.01) |
| ***E21B 33/129*** | (2006.01) |
| ***E21B 23/00*** | (2006.01) |
| *E21B 34/00* | (2006.01) |

(52) U.S. Cl.

CPC ..... *E21B 34/12* (2013.01); *E21B 23/006* (2013.01); *E21B 33/12* (2013.01); *E21B 33/1294* (2013.01); *E21B 43/26* (2013.01); *E21B 2034/007* (2013.01)

(58) Field of Classification Search

CPC ..... E21B 33/1294; E21B 2034/007; E21B 34/14; E21B 34/12

See application file for complete search history.

(56) References Cited

U.S. PATENT DOCUMENTS

| | | | |
|---|---|---|---|
| 3,032,111 | A | 5/1962 | Corley, Jr. et al. |
| 3,273,649 | A | 9/1966 | Moody et al. |
| 3,845,818 | A | 11/1974 | Deaton |
| 4,421,182 | A | 12/1983 | Moody et al. |
| 4,804,042 | A | 2/1989 | Knight et al. |
| 5,842,521 | A | 12/1998 | Tetzlaff et al. |

(Continued)

FOREIGN PATENT DOCUMENTS

| | | | |
|---|---|---|---|
| CA | 1298779 | C | 4/1992 |
| CA | 2693676 | A1 | 7/2010 |

(Continued)

*Primary Examiner* — Jennifer H Gay
*Assistant Examiner* — George Gray
(74) *Attorney, Agent, or Firm* — Blank Rome, LLP

(57) ABSTRACT

A tool assembly including an equalization valve allowing for continuous equalization of pressure above and below a sealing element includes a housing having a fluid passageway that is fluidically continuous across a sealing element disposed on a mandrel. The mandrel is part of a sealing assembly that contains the sealing element. The equalization valve includes a valve plug moveable from an open to a seated position wherein the valve plug is seated against the sealing mandrel. The valve plug defines a conduit that provides minimal fluid flow across the sealing element when the valve plug is seated against the sealing mandrel. The equalization valve further includes an outer port for permitting lateral flow of fluid from the tubing string to the annulus defined between the tubing string and the wellbore. The equalization valve may be part of a downhole tool assembly which includes the equalization valve and a sealing assembly.

24 Claims, 8 Drawing Sheets

(56) References Cited

U.S. PATENT DOCUMENTS

| | | | | |
|---|---|---|---|---|
| 6,289,990 | B1 | 9/2001 | Dillon et al. | |
| 6,427,773 | B1 | 8/2002 | Albers | |
| 6,474,419 | B2 | 11/2002 | Maier et al. | |
| 6,655,461 | B2 * | 12/2003 | Eslinger et al. | 166/305.1 |
| 6,763,892 | B2 | 7/2004 | Kaszuba | |
| 6,840,323 | B2 | 1/2005 | Fenton et al. | |
| 7,913,770 | B2 | 3/2011 | Schramm et al. | |
| 8,066,074 | B2 | 11/2011 | Maskos et al. | |
| D657,807 | S | 4/2012 | Frazier | |
| 2002/0062962 | A1 * | 5/2002 | Gary et al. | 166/305.1 |
| 2011/0198082 | A1 | 8/2011 | Stromquist et al. | |
| 2012/0055671 | A1 | 3/2012 | Stromquist et al. | |
| 2012/0090847 | A1 | 4/2012 | Getzlaf et al. | |

FOREIGN PATENT DOCUMENTS

| | | | |
|---|---|---|---|
| CA | 2749636 | A1 | 7/2010 |
| CA | 2738907 | A1 | 7/2011 |
| CA | 2766026 | A1 | 7/2011 |
| EP | 2105577 | A1 | 9/2009 |
| WO | WO-2012027831 | A1 | 3/2012 |
| WO | WO-2012051705 | A1 | 4/2012 |

* cited by examiner

TOOL ASSEMBLY INCLUDING AN EQUALIZATION VALVE

RELATED APPLICATION

This U.S. patent application claims priority to U.S. Provisional Application 61/564,657 filed on Nov. 29, 2011, the disclosure of which is considered part of the disclosure of this application and is hereby incorporated by reference in its entirety.

FIELD OF THE INVENTION

This relates to an equalization valve for use in a downhole tool assembly, and to the use of the tool assembly in fracturing operations.

BACKGROUND

Standard tools and methods for use in the completion of a wellbore are well known. Generally, perforations or ports are provided within cased wellbores for delivery of fluid treatment to the surrounding formation. Often, the completion of a wellbore requires fracturing of the formation by forcing proppant-laden fluid through the ports or perforations at high pressures. To efficiently isolate delivery of the fluid treatment to a particular wellbore region, sealing devices such as bridge plugs, friction cups, inflatable packers, and straddle packers are commonly used to isolate portions of the wellbore during fluid treatment. These devices are exposed to varying conditions during use, and debris accumulation around the tool assembly is a concern. When a sealing device is exposed to high fluid pressure differentials along its length, for example during an isolated fracturing operation, equalization of the pressure differential may cause damage to the sealing device. For example, following a fracturing operation, hydraulic pressure equalization across the sealing device will usually result in an immediate surge of fluid from the stimulated perforations or ports. This equalization surge in fluid flow will carry significant amounts of formation debris and sand such that, debris is likely to settle over and about the sealing device, or within other portions of the tool assembly. This may result in tool damage, or in the tool assembly becoming lodged within the wellbore. Increased pressure differential, sudden equalization, and any delay in removal of the tool assembly from the equalized segment further increases the risk of tool damage or lodgment downhole.

Accordingly, equalization across the sealing device during fracturing of sand-laden formations poses significant risk of debris-related tool malfunction, jamming or immobility of the tool assembly, and potential loss of the well if the tool assembly cannot be retrieved.

BRIEF DESCRIPTION OF THE DRAWINGS

Embodiments will now be described, by way of example only, with reference to the accompanying drawings in which.

SUMMARY

Figure 1:
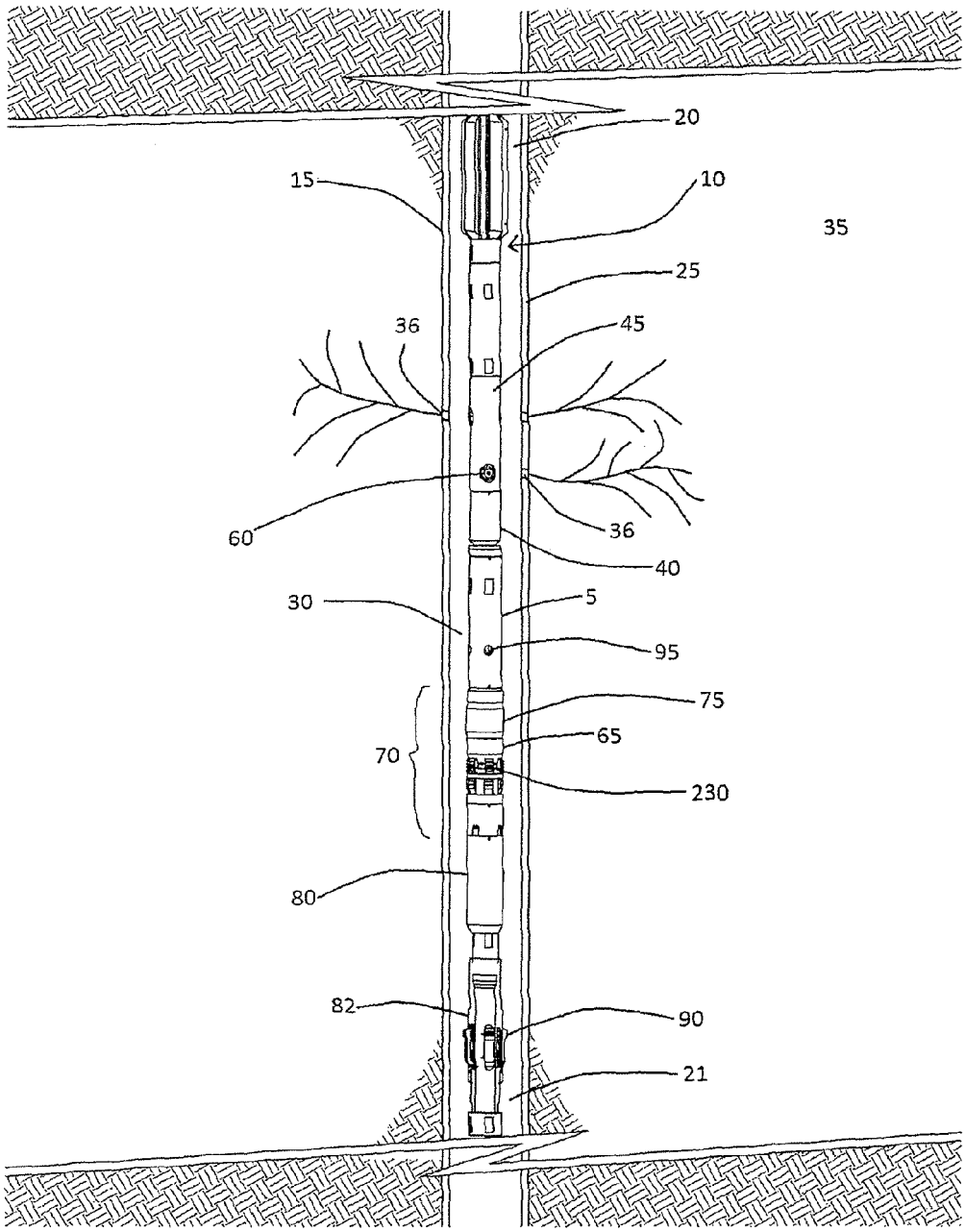
FIG. 1 is a schematic perspective view of a tubing string with an equalization valve according to one embodiment.
Figure 2:
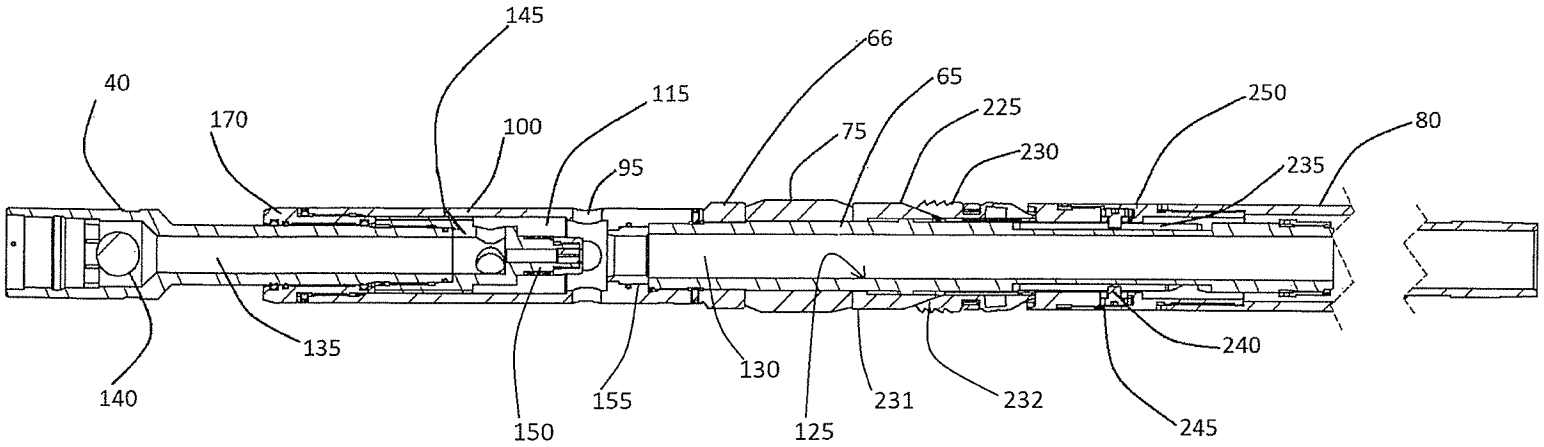
FIG. 2 is a sectional view through the equalization valve and associated sealing assembly when the valve plug is in the open position according to one embodiment.
Figure 3:
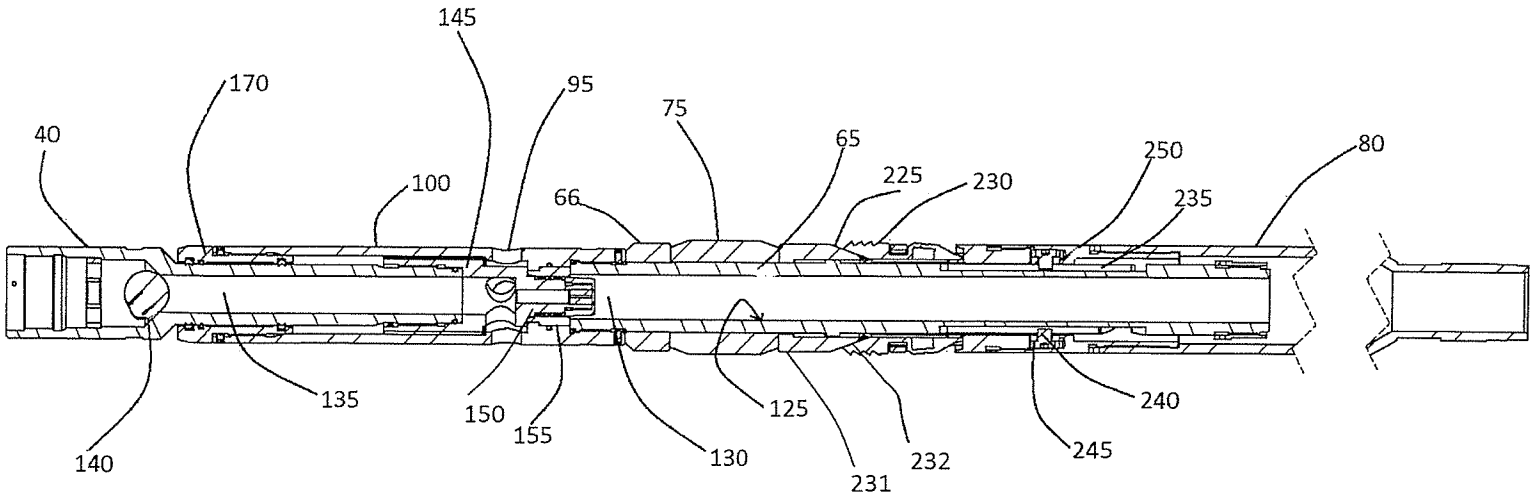
FIG. 3 is sectional view of the equalization valve and associated sealing assembly when the valve plug is in the seated position according to one embodiment.
Figure 4:
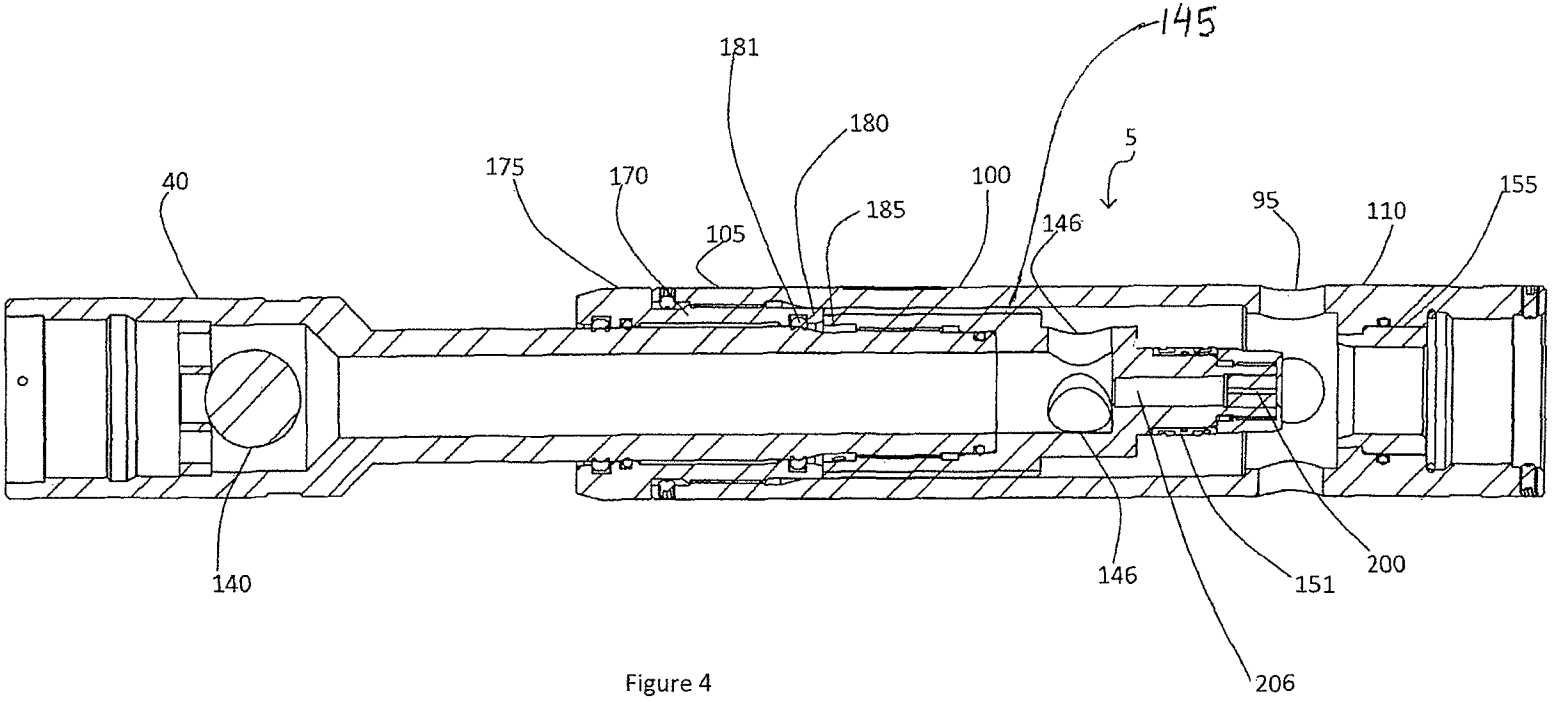
FIG. 4 is a sectional view of the valve plug in open position with associated pull tube according to one embodiment.
Figure 5:
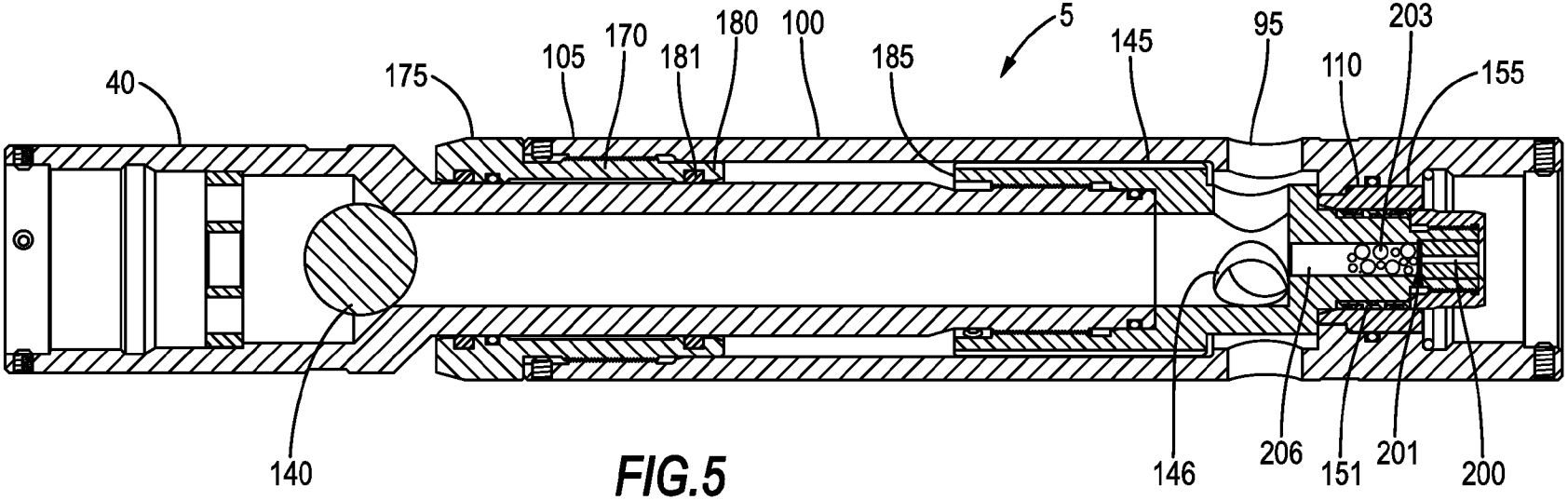
FIG. 5 is a sectional view of the valve plug in seated position with associated pull tube according to one embodiment.
Figure 5A:
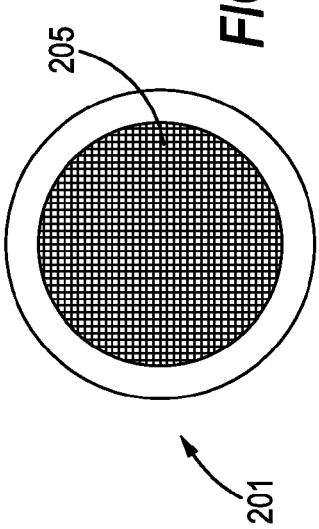
FIG. 5A is a plan view of one embodiment of a filter element that may form a part of the valve plug shown in FIG. 5.

An equalization valve for continuous equalization of hydraulic pressure across a sealing element disposed on a tubing string is described. The valve, and a tool assembly which includes the valve, is adopted for insertion into a tubing string to assist in achieving selective equalization depending on the downhole operation being carried out. More particularly, the valve includes a moveable plug which allows for the selective flow of fluids across a sealing element.

According to one broad aspect, the equalization valve includes a housing having a primary fluid passageway which is continuous with a fluid passageway defined within a sealing mandrel. This primary fluid passageway may also be referred to herein as the primary equalization pathway. The sealing mandrel is part of a sealing assembly that includes a sealing element disposed around the sealing mandrel. The equalization valve also includes a plug that is moveable from a seated position in which it is engaged with the sealing mandrel to an open position in which the plug is unseated from the sealing mandrel. When the plug is in an open position, complete equalization of hydraulic pressure across the sealing element can be achieved because fluid can flow through the primary equalization passageway through the fluid passageway defined in the sealing mandrel and across the sealing element disposed thereon. The plug defines a conduit, the conduit being fluidically continuous with the fluid passageway of the sealing mandrel and the primary equalization passageway and allowing for a minimal fluid flow therethrough. The conduit forms a secondary equalization pathway that allows for fluid flow across the sealing element when the plug is in the seated position. The sealing element remains engaged against the wellbore while fluid flow through the secondary equalization pathway is occurring. Thus, this secondary equalization pathway allows for continuous equalization of hydraulic pressure across the sealing element without compromising the integrity of the sealing element against the wellbore.

In one embodiment, the equalization valve further includes at least one outer port that allows for fluid communication between the interior of the tubing string and the wellbore. The valve plug may also have at least one inner port. The inner port can be aligned with the outer port of the valve housing when the plug is in the seated position.

In one embodiment, the conduit, which forms the secondary equalization pathway in the valve plug may be provided as an insert, or as part of an insert which is positionable within a recess defined in the plug. The insert may be removed from the plug when continuous equalization across the sealing element is not desired.

According to one broad aspect, when performing downhole operations such as fracturing, the valve plug may be in seated position, with only a small amount of fluid flow through the secondary equalization pathway of the valve plug to the tubing string below the sealing element being permitted. The sealing element remains set against the wellbore during this time. When operations are complete, the plug is moved from its seated position to an open or unseated position by application of a mechanical force to the tubing string. When the valve is in the open position, fluid flow through the primary fluid passageway of the equalization valve is permitted and hydraulic pressure across the sealing element is equalized as a result of the fluid flow. The sealing element returns to an unset set (where it is not compressed against the wellbore).

According to another broad aspect, the equalization valve may be part of an equalization assembly, the equalization assembly including both the equalization valve and the sealing assembly. The equalization assembly may be part of a downhole tool to be used in a debris-laden or high-solids environment. Permitting a relatively small amount of fluid communication across the sealing element so as to provide continuous equalization during fracturing reduces the excessive fluid and debris surge effect following termination of the fluid treatment, without compromising the isolation and without excessive fluid loss. Fluid passage across the sealing element may further serve to wash the tool assembly and wellbore below the sealing element.

In one broad aspect, there is provided an equalization valve adapted for insertion within a tubing string for deployment within a wellbore. The valve comprises:

a valve housing comprising: a first end connectable to a length of tubing string and a second end connectable to a mandrel disposed on the tubing string, the housing further including a primary fluid passageway defined therethrough; the primary fluid passageway being continuous with a fluid passageway defined in the interior of the mandrel; and an outer port for permitting fluid flow from the interior of the tubing string to the wellbore;

a valve plug slidably disposed within the equalization between a seated position and an open position, wherein in the seated position the valve plug is seated against the mandrel to an open position wherein valve plug is not seated against the mandrel; the valve plug including a conduit which is fluidically continuous with the fluid passageway of the mandrel and the length of tubing string above the housing, so as to allow continuous fluid flow across a sealing element disposed on the mandrel when the valve plug is in the seated position.

In one embodiment, the valve plug further includes an inner port that is fluidically continuous with the tubing string and can be aligned with the outer port of the valve housing when the valve plug is in the seated position.

In one embodiment, the primary fluid passageway of the valve housing may extend from the upper end of the valve housing to the lower end of the valve housing.

In one embodiment, the valve is associated with a sealing assembly which includes the mandrel and the sealing element, the valve plug being actuated from its seated to unseated position by a mechanical force applied to the tubing string.

In one embodiment, the upward movement of the valve plug is limited by engagement of a shoulder on the valve plug with of region of the tubing string at the upper end of the valve housing. The valve plug is coupled to a tubular element disposed on tubing string. The tubular element may be a pull tube. Mechanical force is applied to the pull tube to actuate movement of the valve plug.

In one embodiment, the valve plug may permanently connected, attached or affixed to the tubing string or it may be removable from the valve housing.

In one embodiment, the conduit in the valve plug may be provided as an insert, the insert being positionable within a recess defined in the valve plug. The insert is removable.

In another broad aspect, there is provided a tool assembly adapted for connection to a tubing string to be deployed within a cased wellbore. The tool assembly comprises:

a sealing element disposed about a sealing mandrel on the tubing string, the sealing mandrel having a first end and second end, and defining a fluid passageway extending from the first end to the second end, the sealing element being actuable between a set position in which it is engaged against the casing to an unset position in which it is disengaged from the casing, an equalization valve comprising: a housing having a fluid passageway which is fluidically continuous with the fluid passageway of the sealing mandrel, an outer port for fluid communication between the interior of the tubing string and the annulus defined between the casing and the tubing string; and a valve plug slideable from a seated position in which the valve plug is in sealing engagement with the sealing mandrel to an open position in which the sealing mandrel is unobstructed by the valve plug, the valve plug further comprising a conduit of smaller size than the fluid passageway of the valve housing, to allow for fluid flow to the sealing mandrel when the plug is in the seated position, the sealing element remaining set against the casing while fluid flow through the conduit is occurring.

In one embodiment, the sealing element is actuated by a J-slot mechanism. The J-slot is formed within an outer diameter of the sealing mandrel.

In one broad aspect, there is provided a method of continuously equalizing pressure across a sealing assembly depleted in a cased wellbore. The method comprises:

lowering a tubing string having a sealing assembly and equalization valve to a desired location in a wellbore, the tubing string being in fluid communication with the wellbore by a port defined in the equalization valve, the equalization valve having a primary fluid passageway defined therethrough for permitting fluid communication through the tubing string above and below the sealing assembly, and a secondary equalization passageway for allowing a restricted fluid flow above and below the sealing assembly;

blocking fluid communication across the primary fluid passageway of the equalization valve, while permitting a restricted fluid flow to occur through the secondary equalization passageway;

compressing a sealing element within the sealing assembly to engage and seal against the casing;

performing downhole operation while the sealing element is set against the casing and the restricted fluid flow is occurring;

applying mechanical force to the tubing string to allow fluid flow through the primary equalization passageway across the sealing assembly; and disengaging from the sealing element from the casing such that fluid flow can occur through the tubing string.

It is to be understood that other aspects of the teachings will become readily apparent to those skilled in the art from the following description, wherein various embodiments are shown and described by way of illustration.

DETAILED DESCRIPTION

This disclosure relates to an apparatus adopted for insertion into a tubing string. The apparatus may be an equalization valve may be an equalization assembly which includes an associated sealing assembly, as will be described below.

The equalization valve is a dual-stage valve in that the valve provides for continuous equalization of hydraulic pressure across the sealing element at any time, as well as allowing for complete equalization of hydraulic pressure across the sealing element after wellbore operations are complete and it is desired to unset the sealing element from its engagement with the wellbore. The valve includes a narrow fluid conduit which provides a secondary equalization passageway allows for partial equalization of the pressure differential across the sealing element, preventing excess fluid surge and debris accumulation upon termination of fluid treatment and release of the sealing element. The secondary equalization pathway also provides for minimal washing effect, bathing the tool assembly below to prevent debris accumulation.

According to the present disclosure, a segment of the wellbore may be isolated, meaning that an effective hydraulic isolation is established in that the sealing element is in sealing engagement with the wellbore (which may be cased wellbore) and that no fluid can pass between the wellbore above the sealing element to the wellbore segment below the sealing element. A small amount of fluid flow is occurring across the sealing element, but this fluid flow does not affect the sealing engagement of the sealing element with the wellbore.

Referring to FIG. 1, a schematic representation of an equalization valve 5 adapted for insertion within a tubing string 10, according to one embodiment is shown. The tubing string 10 extends through a wellbore 15. The tubing string 10 has an upper end 20 and a lower end 21. A casing 25 may be disposed in the wellbore 15. An annulus 30 is defined between the tubing string 10 and the casing 25. The wellbore 15 intersects a formation 35. The formation 35 is in fluid communication with the annulus 30 through perforations 36 within the casing 25.

The equalization valve 5 is coupled at its upper end to a pull tube 40. Pull tube 40 couples the equalization valve to a perforation sub 45. The perforation sub 45 may include a perforation device 50 disposed thereon. The perforation device 50 may include one or more jet nozzles 60.

The equalization valve 5 is connected at its lower end to sealing mandrel 65. Sealing mandrel 65 is part of a sealing assembly 70. Sealing assembly 70 also includes a resettable sealing element 75. Mechanically actuated locking devices or slips 230 may be positioned below the sealing element 75 to resist movement down the wellbore when the sealing element 75 is in "set" position (i.e. sealed against the wellbore). As will be discussed below, the slips 230 may be actuated through a continuous J-mechanism. The lower end of sealing mandrel 65 is engageable with a crossover sub 80. Crossover sub 80 may be coupled to an anchor sub 82. Anchor sub 82 may include a mechanical casing collar locator 90, or similar positioning device for locating sealing element 75 in the desired region of wellbore 15.

The equalization valve 5 defines at least one outer port 95 which intersects a fluid passageway in the valve (the fluid passageway, as will be described below, is referred to as the primary equalization passageway). Thus, outer port 95 serves to communicate fluid flow between the annulus 30 and the interior of tubing string 10. In addition, fluid communication between the tubing string 10 and the wellbore 15 can occur through perforations 36 in the casing 25.

Referring to FIGS. 2 to 8, equalization valve 5 comprises a valve housing 100 having an upper end 105 and a lower end 110. Valve housing 100 defines a fluid passageway 115, extending from the upper end 105 of valve housing 100 to the lower end 110 of valve housing 100. The fluid passageway 115 of the valve housing 100 forms the primary equalization passageway of the tubing string into which the valve is inserted. By "primary" equalization passageway, it is meant that when unobstructed, this passageway allows for complete or substantially complete equalization of hydraulic pressure between the region of the tubing string 10 above the sealing element 75 and the region of the tubing string 10 below the sealing element 75.

Figure 6:
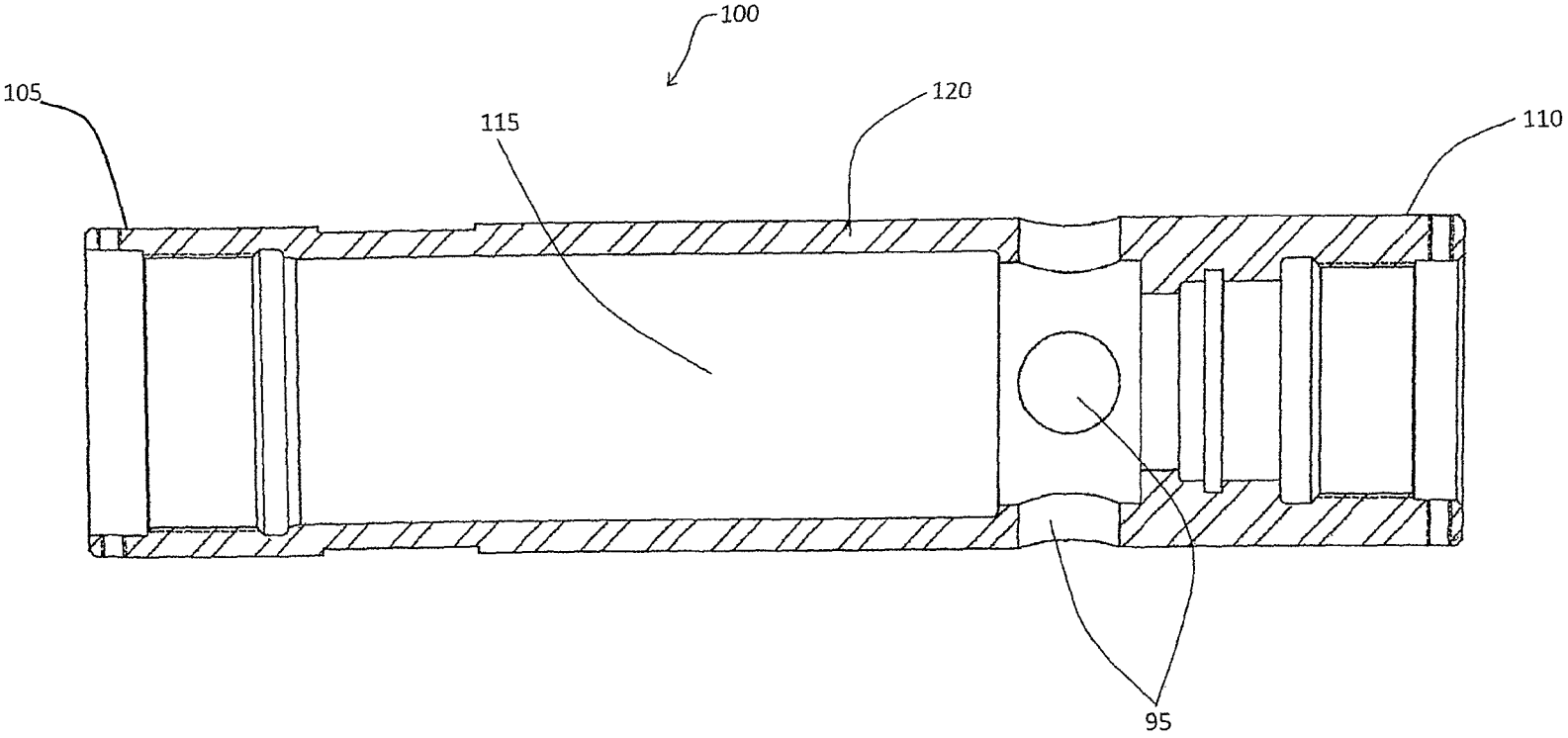
FIG. 6 is a sectional view of the valve housing according to one embodiment.
Figure 7:
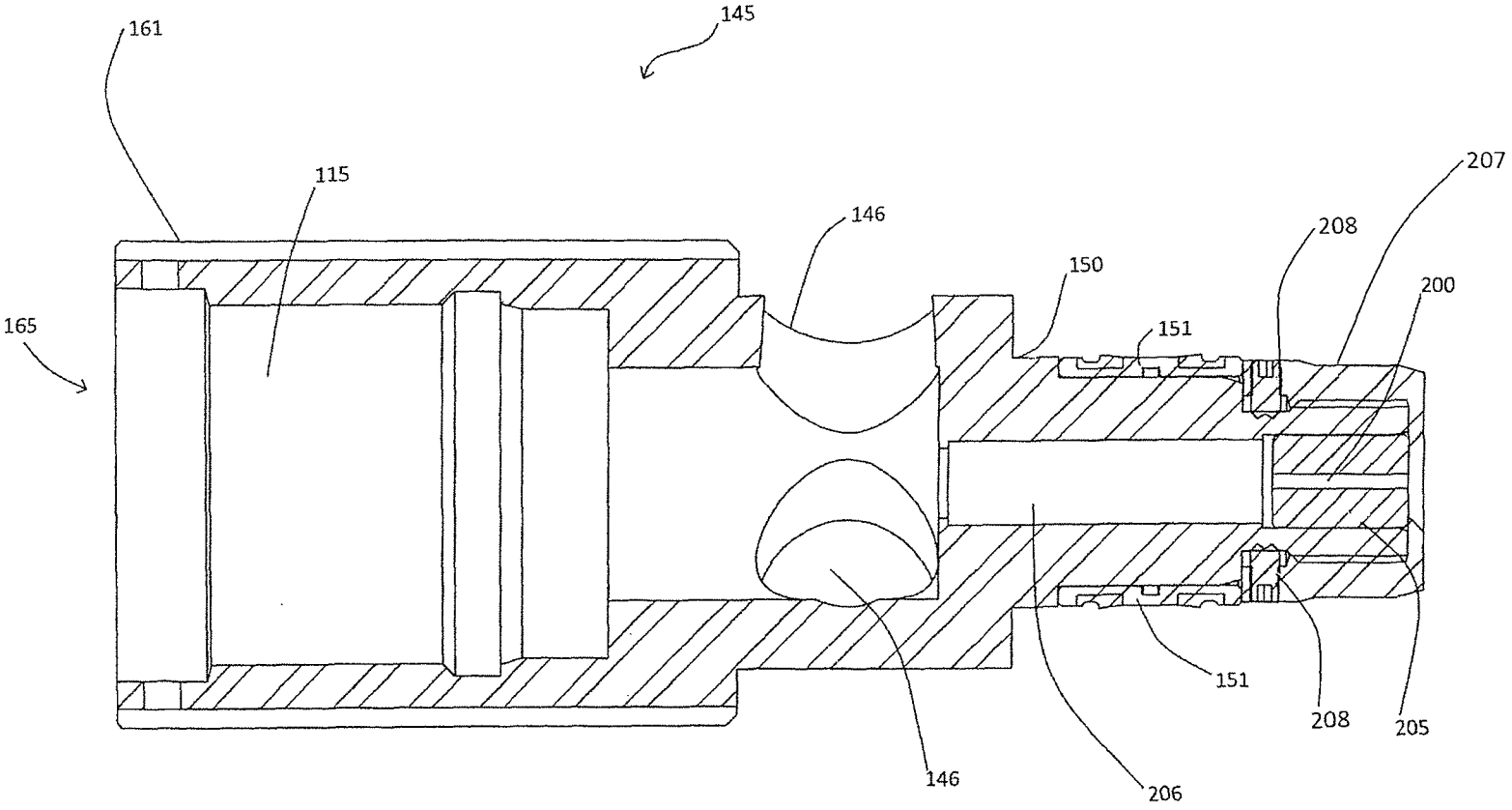
FIG. 7 is a sectional view of the valve plug according to one embodiment.

Referring to FIG. 6, valve housing 100 has an outer port 95 defined in the wall 120 of equalization valve housing 100. The outer port 95 is continuous with the primary equalization passageway 115 of valve housing 100, and allows for fluid communication between the interior of the tubing string 10 and the annulus 30 formed between the exterior of the tubing string 10 and the casing 25.

Valve housing 100 is connected at its lower end 110, to a sealing mandrel 65 disposed on the tubing string 10. The connection means may be a threaded connection, or any similar coupling or connecting means. Sealing mandrel 65 has an inner diameter 125 that defines a fluid passageway 130 that is continuous with the primary equalization passageway 115. Valve housing 100 is connected at its upper end 105 to the tubing string 10. In the embodiment shown in the figures, the upper end 105 of valve housing 100 is coupled with a pull tube 40 disposed on the tubing string 10. Mechanical force can be applied to pull tube 40 to actuate the primary and secondary equalization pathways and to actuate sealing assembly 70, as will be discussed in more detail below.

The pull tube 40 has a fluid passageway 135 defined therein. The fluid passageway 135 of the pull tube 40 is fluidically continuous with the primary equalization passageway 115 and with the inner passageway 130 defined in the interior of sealing mandrel 65. Thus, fluid can flow through the tubing string 10 through the pull tube 40, through the valve housing 100 and through the inner passageway 130 of sealing mandrel 65 to the tubing string 10 below sealing element 75. The pull tube 40 may contain a ball and seat valve 140 to allow control of fluid backflow through from the equalization valve 5 to the tubing string 10 above the equalization valve 5. Pull tube 40 is actuated by mechanical force applied to the coiled tubing to which it is connected.

A valve plug 145 is slidably disposed within valve housing 100. The valve plug 145 includes a valve stem 150. The valve stem 150 is sized for mating engagement within a valve seat 155 formed within sealing mandrel 65 so as to seal the inner passageway 130 of the sealing mandrel 65. When valve plug 145 is in the seated position, fluid flow from the primary equalization passageway 115 to the inner passageway 130 of the sealing mandrel 65 is blocked. When the valve plug 145 is seated within the valve seat 155, this position is referred to the seated or sealed position of the valve plug 145, and this position defines the lowermost limit of movement of valve plug 145. When the valve plug 145 is not seated within the valve seat 155 (i.e. open or unseated position), fluid can flow through the primary equalization passageway 115 to the inner passageway 130 of the sealing mandrel 65.

The valve plug 145 has an inner port 146 that allows for reverse circulation of fluid through the tubing string. The inner port 146 can be aligned with the outer port 95 of valve housing 100 when valve stem 145 is seated within valve seat 155.

Given the abrasive environment in which the equalization valve 5 may be operated, the valve stem 150 is composed of an erosion-resistant material such as a carbide or ceramic, and a seal 151 may be present about the valve stem 150 to seal against the primary equalization passageway 115 of valve housing 100 when the valve stem 150 is seated within valve seat 155. Also, the valve plug 145 may be machined to any suitable configuration that will provide a valve stem 150 for seating engagement with the sealing mandrel 65 on which sealing element 75 is disposed, and which is actuable by application of a mechanical force applied to the tubing string. The valve seat may also be formed in a connecting sub, for example, and valve seat as used herein includes any means to receive the valve stem so that it is engaged with the sealing mandrel.

The valve plug 145 has an enlarged upper end 161 which forms a hollow core 165 capable of receiving pull tube 40. A lock nut 170 having an upper end 175 and a lower end 180 is connected to the upper end 105 of valve housing 100, such that the upper end 175 of lock nut 170 forms a shoulder over the upper end 105 of valve housing 100. A set screw 181 couples lock nut 170 to valve housing 100. The lower end 180 of lock nut 170 and extends beneath the equalization valve housing 100 to engage with a shoulder 185 of the valve plug 145. In this way, the lower end 180 of the lock nut 170 is sandwiched between the interior surface of equalization valve housing 100 and the exterior surface of pull tube 40. The lower end 180 of the lock nut 170 thus defines a stop position for upward movement of the valve plug 145. Thus, the uppermost position of the valve plug 145 occurs when the shoulder 185 of the valve plug 145 is abutted against a lower end 180 of lock nut 170. Other means of coupling the plug to the valve housing are possible, so long as the plug is engageable with the tubing string, and that force can be applied to the tubing string to actuate movement of the plug.

A conduit 200 is defined within valve stem 150. The conduit 200 is continuous with the primary equalization passageway 115 and the inner passageway 130 defined in the sealing mandrel 65. This conduit 200 is also referred to a secondary equalization passageway because it is allows for continuous equalization of hydraulic pressure between the region of the tubing string 10 above the sealing element 75 to the region of the tubing string 10 below the sealing element 75, even when the valve plug 145 is in the seated position within valve seat 155.

In the embodiment shown in the figures, conduit 200 is provided within a valve insert 205. The valve insert 205 is receivable within a recess 206 defined within the equalization valve stem 150. The secondary equalization passageway 200 has a reduced size compared to the primary equalization passageway 115 so as to allow for restricted or reduced fluid flow compared to the fluid flow that would occur through the primary equalization passageway 115 when the valve plug is unseated. The insert 205 is removable. In the embodiment shown in the figures, the valve stem has a recess 206 defined therein, and the insert 205 is provided at the end of the flow path. Other arrangements are possible, provided that a minimal fluid communication pathway is formed between the valve housing 100 and the sealing mandrel 65 when the valve plug is in the seated position. In the embodiment shown in the figures, insert 205 is held in place by a back-up ring 207 which is turn held in place by set screws 208. In this arrangement, the back-up ring will become engaged within valve seat 155 when valve plug 145 is in seated position.

A screen or filter 201 may be positioned across the secondary equalization passageway 200 to prevent sand and other debris from passing to the inner passageway 130 of sealing mandrel 65. The filer may be a layer of particulate matter 203 held over the port and/or may include a screen 205 of appropriate mesh size. However, it is not necessary that there is a screen or filter, particularly when the equalization valve is used in conjunction with a downhole tool that incorporates many debris relief passageways.

As will be explained in more detail below, the sealing element 75 remains sealed against the wellbore despite this restricted fluid flow through the secondary equalization passageway because the force required to unseat and seat the valve plug 145 is less than the force required to actuate the sealing element 75. The hydraulic flow is maintained even during the application of fluid treatment to the wellbore. Due to the relatively low rate of fluid passage, the hydraulic pressure above the sealing element is greater than the hydraulic pressure below the sealing element during application of fluid treatment. Thus, the seal may be pressure tested even with the continuous partial equalization across the sealing element. Further, both the treatment application pressure and bottomhole pressure may be monitored during fluid treatment.

The insert 205 is a carbide insert of the type normally used as a nozzle in jet perforation assemblies. The valve stem 150 is shaped to receive a jet perforation nozzle, for example of the type typically known, the nozzle having an outside diameter of about ½ inch and an inner diameter (which forms the secondary equalization passageway) varying from about ⅛ inch to ⅜ inch. Such inserts are known in the field and are readily available. However, as stated, there is no requirement for the secondary equalization passageway to be provided as an insert within the valve stem, and the valve stem may simply have a permanent conduit provided therein, the conduit forming the secondary equalization passageway. For example, the insert may be selected from a set of modular inserts, each insert of the set having a conduit (which forms the secondary equalization passageway) of varying size. Therefore, the amount of fluid flow across the sealing element can be selected depending on the application in question.

A variety of sizes for the conduit 200 may be suitable, but typically the conduit 200 will have a diameter between ⅛ inch and ¾ inch. For example, a 3/16 inch diameter is deemed suitable. The configuration of the conduit may be customized to a particular wellbore, completion, or operation. When the conduit is provided as an insert within the valve stem, it may be replaced as needed with another suitable insert. In addition, the entire valve plug may be removed from the equalization and replaced as needed.

Referring to FIGS. 2 to 7, the equalization valve 5 is associated with a sealing assembly 70. The sealing assembly 70 includes sealing mandrel 65, a gage ring 66, a compressible sealing element 75 disposed about sealing mandrel 65 and setting cones 225 disposed about sealing mandrel 65. In the set or sealed position, sealing element 75 is engaged against the casing 25 to seal fluid flow from the region of the wellbore above the sealing element 75 to region of the wellbore below the sealing element 75. Setting cones 225 are disposed about the sealing mandrel 65. Setting cone 225 has an upper end 231 and a lower tapered end 232. Upper end 231 of setting cone 225 engages lower end of sealing element 75 while tapered end 232 of setting cone 225 extends radially outward from sealing mandrel 65. Lower tapered end 232 is juxtaposed against mechanically actuated slips 230 which are also disposed around the sealing mandrel 65. These slips 230 are adapted to engage the casing 25 when the sealing element 75 is set, as will be described below. The gage ring 66 is positioned about sealing mandrel 65 such that it engages the lower end of sealing element 75.

Figure 8:
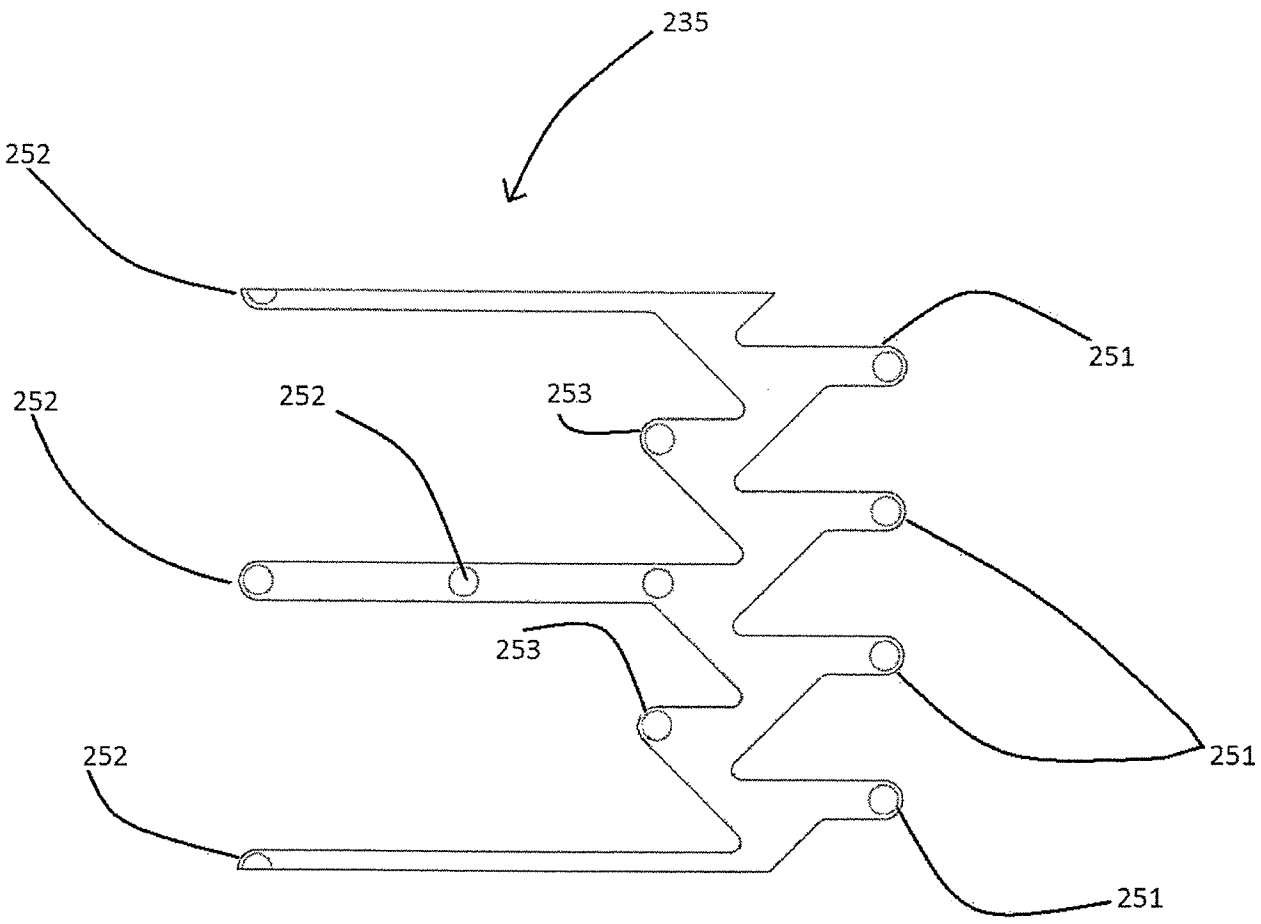
FIG. 8 is a flat pattern on the J-slot defined in the sealing mandrel according to one embodiment.

A J-slot 235 is defined within the outer diameter of the sealing mandrel 65 for actuating the sealing element 70. Various J-slots suitable for actuating mechanical set packers and other downhole tools are known within the art. The J-slot 235 illustrated in the FIG. 8 is a continuous J-slot. At least one J-pin 240 extends outwardly from sealing mandrel 65 and is retained within J-slot 235 defined in sealing mandrel 65. The J-pin 240 is held is place by a clutch ring 245. The clutch ring 245 is comprised on two concentric halves, which together encompass the outer diameter of sealing mandrel 65. The clutch ring 245 is held in place against sealing mandrel 65 in a clutch housing 250. The clutch housing 250 is threadedly connected to crossover sub 80. Thus, the clutch housing 250 couples the crossover sub 80 with sealing mandrel 65. The crossover sub 80 may be coupled to an anchor sub that holds the mechanical collar locator or similar locating device. Alternative arrangements are possible.

Debris relief apertures may be present at various locations within the J-slot 235 to permit discharge of settled solids as the J-slot 235 slides relative to J-pin 240. The J-slot 235 is also deeper than would generally be required based on the pin length alone, which further provides accommodation for debris accumulation and relief without inhibiting actuation of the sealing element. As shown in FIG. 8, J-slot 235 has 3 pin positions: a set position 252 (in which the sealing element is engaged against the wellbore and the equalization valve seated), a pull position 251 (in which the sealing element is not engaged against the wellbore) and a run position 253 (in which the equalization valve is unseated and the equalization valve is not set).

Operation:

Generally, the equalization valve may be used in fracturing and in particular when fracturing in the presence of sand and other debris. When a downhole operation is to begin, a tubing string, such as that schematically shown in FIG. 1, is lowered into the wellbore 15. Once the sealing element 75 reaches the desired location within the wellbore 15, an upward force is applied to the pull tube 40. This causes the locator such as the mechanical collar casing locator to engage the casing. Upward pull is stopped and then, downward force is applied.

The downward force applied to the pull tube 40 causes the valve plug 145 to disengage from its abutment with the lock nut 170 and move downward to its seated position within the valve seat 155. Continued downward force on the pull tube 40 causes the sealing mandrel 65 to slide downward relative to the J-pin 240 which is held in position by clutch ring 245.

As this downward force is occurring, J-pin 240 will be moved from the pull position 251 to the set position 252. As the sealing mandrel 65 slides downward, slips 230 are driven outward to engage casing due to the resistance of the setting cone 225 against slips 230. Sealing element 75 is positioned between gage ring 66 and setting cone 225 and downward movement of sealing mandrel 75 causes the sealing element to push outward, sealing against the casing 25. In the set position, fluid flow from the wellbore above the sealing element 75 to the wellbore below the sealing element 75 is prevented. In this position, equalization plug is in the seated position, and fluid flow through the primary equalization passageway 100 is prevented. However, fluid flow through the secondary equalization pathway 200 can still occur. The sealing element 75 remains set against the casing 25 while this restricted fluid flow is occurring. In addition, fluid communication between the tubing string 10 and the annulus 30 defined between the casing 25 and the exterior of the tubing string 10 is possible through the outer port 95 defined in valve housing 100 and the inner port 146 defined in valve plug 145. During this time, operations such as fracturing can be performed. Sand-laden fluid is pumped into the formation, through the casing or annulus, or both.

Once operations are complete, the downhole tool assembly is to be moved to a new location, and thus, the sealing element 75 must be unset. Upward force is applied to the pull tube 40, the valve stem 150 is disengaged from it seated position within valve seat 155 and slides upward, until the shoulder of the valve plug 145 is abutted against lock nut 170. As the valve stem 150 is not seated within sealing mandrel 65, fluid flow can occur between the tubing string above and below the sealing element 75 through the primary equalization pathway 115 defined in the valve housing 100.

Fluid flow can also occur between the outer port 95 of the equalization valve 5 and the interior of the tubing string 10, allowing for complete equalization of pressure within the lateral direction (i.e. between the interior of the tubing string and the annulus) and the longitudinal direction (i.e. within the tubing string). Because fluid can flow down the tubing, hydraulic pressure is equalized. As the lower end 110 of the valve housing 100 is attached to the sealing mandrel 65, continued upward force applied to the pull tube 40 will also slide sealing mandrel 65 upward, and J-pin 240 will gradually be pulled upward, from a set position 252 to a pull position 251. The sealing element 75 returns to its unengaged or decompressed state (where it is not set against the casing), the setting cone 225 is pulled upward by the sealing mandrel 65 and the slips 230, no longer being pressed into the casing 25 by the setting cone 225 are forced back into a tuck position by springs. Thus, these actions will cause sealing element 75 to disengage from casing 25 and slips 230 to disengage from the casing 25. The downhole tool assembly can then be moved to a different wellbore segment to be treated.

In respect of the differing forces required to seat and unseat the valve plug and to set and unset the sealing element, the following is noted: after the tool assembly is moved to the appropriate location and the locator (such as the mechanical collar locator) is engaged with the casing, a first mechanical force is applied to the tubing string (through the coiled tubing connected thereto) so as to seat the valve plug 145 in the valve seat 155. A second mechanical force is then applied to move the sealing mandrel 65 relative to J-pin 240 so that the J-pin 240 is moved from the run position 253 to the set position 252. The second mechanical force is generally greater than the first mechanical force. As fracturing operations are occurring, a hydraulic pressure differential is created across the sealing element 70. Once operations are complete, the valve plug is moved to its unseated or open position by mechanical force applied to the tubing string 10. As fluid flow can occur across the sealing element 70, hydraulic pressure is quickly equalized. The sealing element 70 becomes disengaged and the sealing mandrel 65 can be slide relative to J-pin 240 such that J-pin 240 moves from the set position 252 to the pull position 251.

In any of the embodiments described herein, many fluid communication pathways are available for debris relief, whether the sealing element is set or unset, and whether the valve plug is seated or unseated. In any position of the valve plug, fluid communication between the annulus and the valve housing is available, and when the ball and seat are not present above the pull tube, fluid may be circulated from the tubing string to the valve housing and wellbore annulus. Thus, two potential circulation flowpaths from surface to the treated interval are provided—through the tubing string or down the wellbore annulus. Using the presently described valve and suitable variants, fluid may be circulated through the valve housing when the equalization valve is in any position, providing constant flow through the secondary equalization pathway to prevent clogging with debris. Accordingly, the equalization valve may be particularly useful when incorporated into downhole assemblies deployed in sand-laden environments.

While the above-mentioned embodiments describe a sealing element, any suitable sealing device that permits effective hydraulic isolation of the interval to be treated may be used.

For example, inflatable packers, compressible packers, bridge plugs, friction cups, straddle packers and others known in the art may be used. Such sealing devices are generally used with a locating device to ensure that the seal is placed at the appropriate location of the wellbore segment. Also, the sealing assembly may have variations, and may not include the exact features of the sealing assembly described herein.

When a jet perforation assembly is present above the pull tube 40, a ball and seat valve 140 may be present within the pull tube to allow fluid delivered down the tubing string to be delivered through the jet nozzles 60. Subsequently, fluid may be circulated to the perforations 36 by flushing the wellbore annulus alone. During this flushing, a sufficient fluid volume may be delivered through the tubing string to maintain the ball within the ball and seat valve 140 within the pull tube 40 in seated position. Should reverse circulation be required, any fluid delivery down the tubing string 10 may be terminated, while delivery of fluid to the wellbore annulus continues. Fluid will circulate through the outer port 95 of the valve housing 100, and through the inner port 146 of the valve plug. This fluid unseats the ball within the pull tube 40, and thereby providing a return fluid flowpath to surface through the tubing string. It is noted that such flushing is possible regardless of the position of the valve plug 145 within valve housing 100, as a fluid pathway from the wellbore to the valve housing is present in any position of the valve plug or sealing assembly. Accordingly, the wellbore annulus may be flushed by forward or reverse circulation even when the sealing element 75 is actuated and valve plug 145 is in the seated position.

A person skilled in the art would appreciate that other configurations of the downhole tool into which the equalization valve is inserted are possible. Moreover, alternative sealing mechanisms are possible so long as the force required to set and unset the sealing element is greater than the force needed to actuate the valve plug from its seated to unseated position.

The equalization valve therefore serves as a multi-function valve, and may be incorporated into various types of downhole assemblies, and manipulated to effect various functions, as required. The equalization valve may be placed within a tubing-deployed assembly and positioned within the assembly to provide selective reverse circulation capability, and to aid in equalizing pressures between wellbore annulus segments, and with the tubing string flowpath to surface.

While the present description focuses primarily on tubing-deployed tool assemblies, a tool assembly with dual-stage equalization passageways may also be deployed on wireline. In a wireline configuration, the valve plug may be actuated mechanically via wireline (for example by hydraulic pressure to set and pulling on the wireline to unset), while the sealing element is actuated by an electrical signal delivered to the tool assembly via wireline.

In the embodiment shown in the drawings, it is advantageous that the pull tube actuates both the equalization plug and the J-mechanism. However, other mechanisms for providing this functionality will be apparent to those skilled in this art field upon reading the present description, and it is understood that such variant should be considered equivalent with and encompassed by the present teaching.

The previous description of the embodiments is provided to enable any person skilled in the art to make or use the downhole tool assembly and the valve. Various modifications to those embodiments will be readily apparent to those skilled in the art, and many modifications and changes to the embodiments set forth above are possible without departing from the scope and spirit of the invention.

The invention claimed is:

1. A tool assembly adapted for connection to a tubing string to be deployed within a cased wellbore, the tool assembly comprising:

a sealing element disposed about a sealing mandrel on the tubing string, the sealing mandrel having a first end and second end, and defining a fluid passageway extending from the first end to the second end, the sealing element being actuable between a set position in which it is engaged against the casing to an unset position in which it is disengaged from the casing; and, an equalization valve comprising: a valve housing comprising: a first end connectable to the tubing string and a second end connectable to the mandrel disposed on the tubing string, the housing further including a primary fluid passageway defined therethrough; the primary fluid passageway being continuous with a fluid passageway defined in the interior of the mandrel; and an outer port for permitting fluid flow from the interior of the tubing string to the wellbore; and a valve plug slidably disposed within the equalization valve between a seated position and an open position, wherein in the seated position the valve plug is seated against the mandrel to an open position wherein the valve plug is not seated against the mandrel; the valve plug including a conduit which in all valve plug positions is fluidically continuous with the fluid passageway of the mandrel and the length of tubing string above the housing, so as to allow continuous fluid flow across the sealing element disposed on the mandrel when the valve plug is in the seated position and while the sealing element remains engaged against the wellbore.

2. The tool assembly of claim 1, the valve plug further comprising an inner port which is fluidically continuous with the tubing string.

3. The tool assembly of claim 1, wherein the conduit of the valve plug is defined within an insert positionable within the valve plug.

4. The tool assembly of claim 1, wherein the valve plug includes a valve stem for sealingly engaging a valve seat in the mandrel when the valve plug is in the seated position.

5. The tool assembly as in claim 1, wherein the conduit is between ⅛ inch and 1 inch in diameter.

6. The tool assembly as in claim 1, further comprising a filter over the conduit for screening debris from passing through the inner passageway defined in the mandrel.

7. The tool assembly of claim 1, wherein the movement of the valve plug between the open position and the seated position is mediated by application of mechanical force applied to the tubing string.

8. The tool assembly of claim 7, wherein the mechanical force to move the valve plug to its seated position is less than the mechanical force required to actuate the sealing element such that the sealing element becomes engaged against the wellbore.

9. The tool assembly as in claim 1, wherein the valve plug is coupled to a pull tube disposed on the tubing string above the valve housing, the pull tube defining an inner flow path which is continuous with the fluid passageway of the valve housing and with the region of the tubing string above the pull tube.

10. The tool assembly as in claim 9, wherein the valve plug is engaged with the pull tube such that application of mechanical force applied to the pull tube causes the valve plug to move to the seated position.

11. A tool assembly adapted for connection to a tubing string to be deployed within a cased wellbore, the tool assembly comprising:

a sealing element disposed about a sealing mandrel on the tubing string, the sealing mandrel having a first end and second end, and defining a fluid passageway extending from the first end to the second end, the sealing element being actuable between a set position in which the sealing element is engaged against the casing to an unset position in which the sealing element is disengaged from the casing; and, an equalization valve comprising: a housing having a fluid passageway which is fluidically continuous with the fluid passageway of the sealing mandrel, an outer port for fluid communication between the interior of the tubing string and the annulus defined between the casing and the tubing string; and a valve plug slideable from a seated position in which the valve plug is in sealing engagement with the sealing mandrel to an open position in which the sealing mandrel is unobstructed by the valve plug, the valve plug further comprising a conduit of smaller inside diameter than that of the fluid passageway of the valve housing, to allow for fluid flow to the fluid passageway of the sealing mandrel when the slideable valve plug is in any position, wherein actuation of the sealing element from the unset to the set position and the actuation of the valve plug from the unseated to seated position is mediated by application of mechanical force to the tubing string.

12. The tool assembly of claim 11, wherein the mechanical force is applied to a pull tube disposed on the tubing string, the pull tube being coupled to the valve plug, and when the valve plug is in the seated position, the pull tube being coupled to the sealing mandrel.

13. The tool assembly of claim 11, wherein the sealing element is actuated by a J-slot mechanism, the J-slot being defined in the outer diameter of the sealing mandrel.

14. The tool assembly as in claim 11, wherein the valve plug includes a valve stem which is sized for mating engagement with the sealing mandrel.

15. The tool assembly as in claim 11, wherein the conduit is defined within a modular insert positionable within the valve stem.

16. The tool assembly as in claim 15, wherein the modular insert is a jet perforation nozzle.

17. The tool assembly as claim 11, wherein the conduit is between ⅛ inch and 1 inch in diameter.

18. The tool assembly as in claim 11, wherein the valve plug further comprises a filter over the conduit for screening debris from passing to the sealing mandrel.

19. A method of continuously equalizing pressure across a sealing assembly deployed in a cased wellbore, the method comprising:

lowering a tubing string having a sealing assembly and equalization valve to a desired location in a wellbore, the tubing string being in fluid communication with the wellbore by a port defined in the equalization valve, the equalization valve having a primary fluid passageway defined therethrough for permitting fluid communication through the tubing string above and below the sealing assembly, and a secondary equalization passageway for allowing a restricted fluid flow above and below the sealing assembly when the equalization valve is in any position;

blocking fluid communication across the primary fluid passageway of the equalization valve;

compressing a sealing element within the sealing assembly to engage and seal against the casing;

permitting a restricted fluid flow to occur through the secondary equalization passageway while the sealing element remains set against the casing;

performing a downhole operation in the cased wellbore while the sealing element is set against the casing and the restricted fluid flow is occurring;

applying a mechanical force to the tubing string to allow fluid flow through the primary equalization passageway across the sealing assembly; and equalizing pressure across the sealing element such that the sealing element becomes disengaged from the casing.

20. The method of claim 19, further comprising actuating the sealing assembly by a J-mechanism disposed on the region of the tubing string on which the sealing assembly is disposed.

21. The method of claim 19, further comprising permitting fluid flow in a lateral direction between the interior of the tubing string and the annulus defined by the casing and the exterior of the tubing string above the sealing element, while the restricted fluid flow is occurring.

22. The method of claim 19, wherein the downhole operation is fracturing.

23. The method of claim 22, further comprising delivering a fluid down the tubing string such that a ball within a ball and seat valve on the tubing string above the equalization valve is seated, to prevent fluid flow to the equalization valve.

24. The method of claim 23, further comprising the step of delivering fluid down the annulus.

* * * * *